United States Patent [19]

Büchner

[11] 4,079,705

[45] Mar. 21, 1978

[54] TWO-STROKE-CYCLE DUAL-PISTON INTERNAL COMBUSTION ENGINE

[76] Inventor: Bernhard Büchner, Ott-Heinrich-Str. 25, Ingolstadt-Unsernherrn, Germany, 8070

[21] Appl. No.: 677,324

[22] Filed: Apr. 15, 1976

[30] Foreign Application Priority Data

May 28, 1975 Germany ..... 2523712

[51] Int. Cl.[2] ..... F02B 25/12

[52] U.S. Cl. ..... 123/53 B; 123/73 AA; 123/73 AE

[58] Field of Search ..... 123/53 B, 73 A, 73 AA, 123/73 AE, 59 B

[56] References Cited

U.S. PATENT DOCUMENTS

| | | | |
|---|---|---|---|
| 1,149,142 | 8/1915 | Hornor | 123/53 B |
| 2,443,502 | 6/1948 | Guerasimoff | 123/53 B |
| 2,536,960 | 1/1951 | Sherwood | 123/53 B |
| 2,976,861 | 3/1961 | Udale | 123/53 B |
| 3,766,894 | 10/1973 | Mize | 123/53 B |

FOREIGN PATENT DOCUMENTS

| | | | |
|---|---|---|---|
| 594,481 | 6/1925 | France | 123/53 B |
| 921,061 | 12/1954 | Germany. | |
| 633,280 | 12/1949 | United Kingdom | 123/73 A |

*Primary Examiner*—Irwin C. Cohen
*Attorney, Agent, or Firm*—Hans Berman

[57] ABSTRACT

In a two-stroke-cycle dual-piston engine in which a fuel mixture is compressed in the crank chamber by the reciprocating pistons, the compressed fluid flows from the crank chamber and a compartment of one cylinder open toward the crank chamber through a transfer port into a compartment of the other cylinder between the piston therein and the cylinder head, thereafter through a combustion chamber in the cylinder head into the communicating compartment of the first-mentioned cylinder, and the exhaust gases are ultimately discharged through an exhaust port, the transfer port and exhaust port being opened and closed by control devices on the pistons, the exhaust port and transfer port are both controlled by the piston in the first-mentioned cylinder in such a manner that the exhaust port is opened before the transfer port and closed after the transfer port.

7 Claims, 7 Drawing Figures

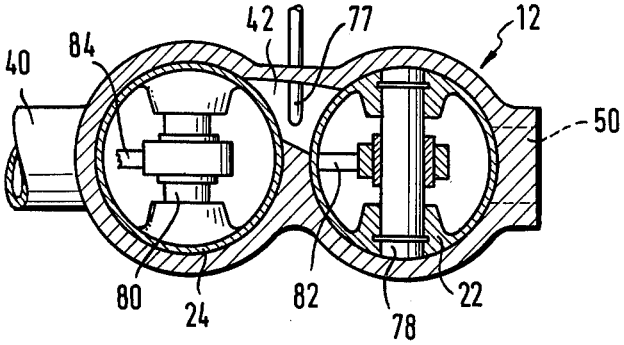
Fig. 2
Fig. 3
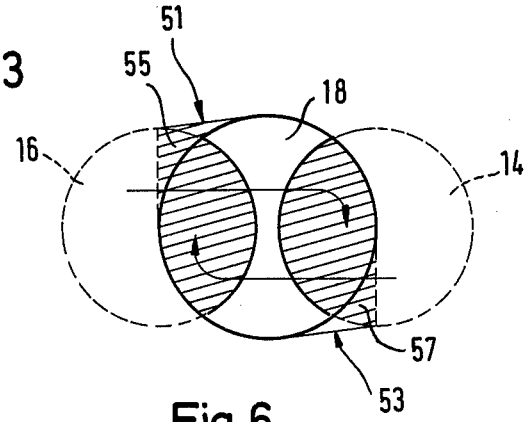
Fig.5
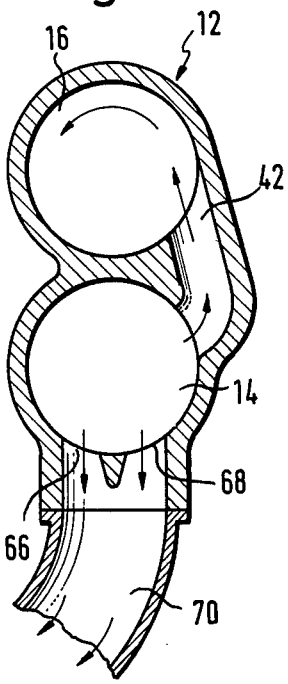
Fig.6
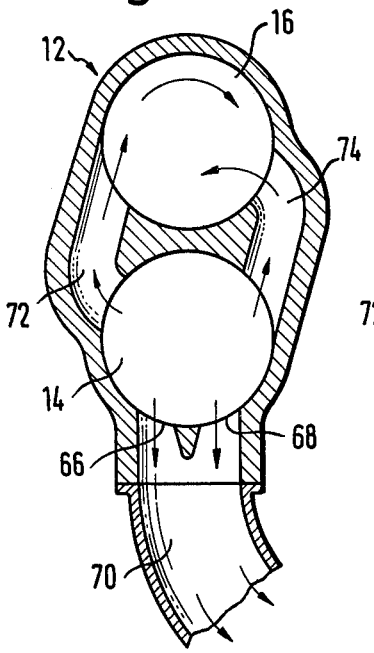
Fig.7
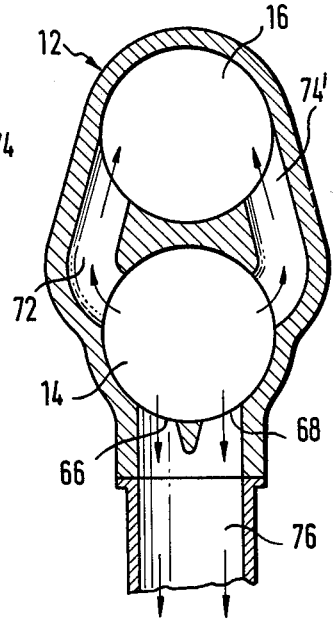

TWO-STROKE-CYCLE DUAL-PISTON INTERNAL COMBUSTION ENGINE

This invention relates to improvements in two-stroke-cycle dual-piston internal combustion engines.

The engine with the improvement of which this invention is concerned is known, for example, from the German Pat. No. 921,061. A fluid is compressed in the crank chamber of the known engine by the two reciprocating pistons, the pistons being connected to a crank shaft assembly in the crank chamber in such a manner that one piston leads and the other trails in all operative conditions of the engine.

The compressed fluid is permitted to flow from time to time through a piston-controlled transfer duct which connects the cylinder compartment bounded by the leading piston and open toward the crank chamber with the compartment of the other cylinder bounded by the trailing piston and the cylinder head. An exhaust port is controlled by the leading piston in such a manner that the exhaust port is opened before the transfer port and closed before the transfer port is closed. The port opening periods are offset from a timing symmetrical relative to the bottom dead center condition of the engine.

It has now been found that the pressure differential between the crank chamber and the combustion space in the known engines is reversed before fluid flow through the transfer port is completed so that a portion of the fresh fuel mixture flows back to the crank chamber before the transfer port is closed. The piston controlling the exhaust port in the known engine is far enough from its bottom dead center position when terminating the exhaust step that the pressure in the cylinder rises rapidly after closing of the exhaust port while the pressure in the crank chamber drops simultaneously at an equally high rate.

It is a primary object of this invention to improve the manner in which fresh fuel mixture is fed to the combustion space of an engine of the type described, and thereby to increase the useful power output of the engine at equal fuel consumption.

This is achieved primarily by controlling the transfer port of the engine in such a manner that the transfer port is opened after the opening of the exhaust port and closed before the closing of the exhaust port. The exhaust port thus is closed while the trailing piston is still near its bottom dead center position and thereby maintains high pressure in the crank chamber. The exhaust port being open simultaneously, the pressure in the combustion space is low and lower than the pressure in the crank chamber during the entire period during which the transfer port is open. No backward flow of fluid from the combustion space into the crank chamber is possible. No energy is lost by pumping fluid back and forth between the crank chamber and the combustion space.

Other features, additional objects, and many of the attendant advantages of this invention will readily be appreciated as the same becomes better understood by reference to the following description of preferred embodiments when considered in connection with the appended drawing in which:

FIG. 2 illustrates the engine of FIG. 1 in section on the line II — II;

FIG. 3 represents dimensional relationships of elements of the same engine in the plane III — III in FIG. 1;

FIGS. 5 to 7 illustrate modified engines of the invention in plan section through their transfer and exhaust ports.

Figure 1:
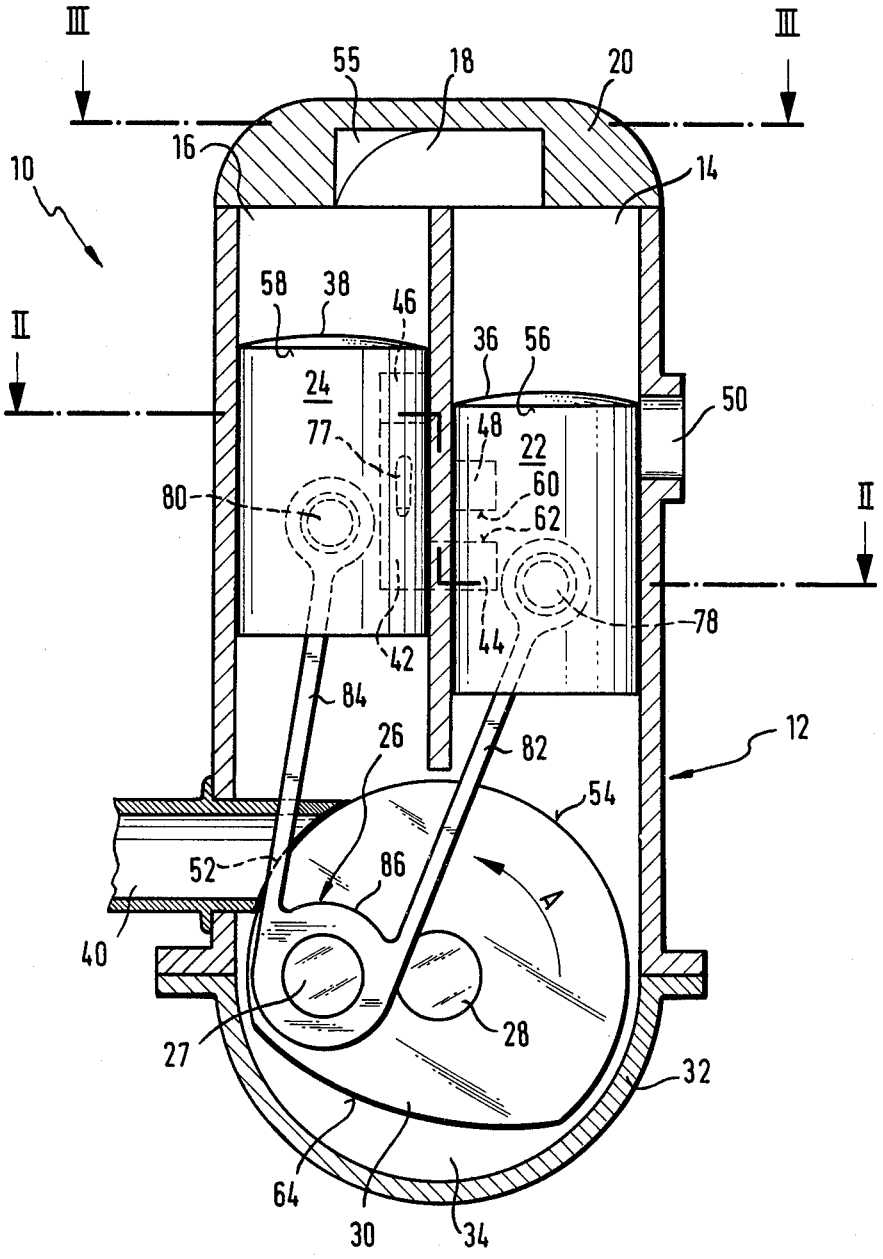
FIG. 1 shows a two-stroke-cycle internal combustion engine of the invention in elevational section on the axes of its two cylinders.

Referring initially to FIG. 1, there is shown a two-stroke-cycle internal combustion engine 10 whose cylinder block 12 defines two cylinders 14, 16 connected by a combustion chamber 18 in the cylinder head 20. Pistons 22, 24 are axially slidably received in the cylinders 14, 16 respectively and are connected to a disc 30 by means of a forked connecting rod assembly 26. The assembly is hinged to the disc 30 by a crank pin 27 eccentric relative to the shaft 28 on which the disc 30 is fixedly mounted. The shaft and associated crank elements rotate in a crank chamber 34 downwardly closed by a trough 32 flanged to the cylinder block 12.

The pistons 22, 24 have each the general shape of an inverted cup so that their tops 36, 38 divide the cavity of each cylinder 14, 16 into an upper compartment near the combustion chamber 18 and a lower compartment open toward the crank chamber 34. The pistons 22, 24 reciprocating toward and away from the crank chamber 34 function as a compressor for a fluid drawn into the crank chamber 34 through an intake duct 40. The fluid may consist of a mixture of combustible fuel and air of combustion or only of air of combustion when the fuel is injected directly into the cylinders as will be presently described.

A transfer port 42 in the wall of the cylinder block 12 separating the two cylinders 14, 16 permits the fluid compressed in the crank chamber 34 to reach the upper cylinder compartments and the combustion chamber 18. A slot-shaped intake orifice 44 of the port 42 is located in the lower compartment of the cylinder 14 in the illustrated piston position, and a slot-shaped discharge orifice 46 of the transfer port is located in the upper compartment of the cylinder 16. A control aperture 48 in the skirt of the piston 22 gives access to the orifice 44 when the piston 22 moves downward from the illustrated position. The upper compartment of the cylinder 14 may communicate with an exhaust port 50 in the cylinder block 12.

As far as described so far, the engine of the invention operates as follows:

When the disc 30 turns counterclockwise in the direction of an arrow A from the illustrated position, both pistons 22, 24 move downward, the piston 22 always leading, and the piston 24 trailing. In the condition of the engine shown in FIG. 1, the intake of fresh air of combustion or fuel mixture through the duct 40 was terminated when an intake port 52 connecting the crank chamber 34 with the duct 40 was sealed by a cylindrical face portion 54 of the disc 30, and the fluid in the crank chamber is partly compressed by the descending pistons 22, 24. The upper circular edge 56 of the piston 22 is about to clear the exhaust port 50 so that the fuel mixture previously exploded in the upper compartments of the cylinders 14, 16 and in the combustion chamber 18 may be discharged.

During further counterclockwise rotation of the disc 30, the discharge orifice 46 in the upper compartment of the cylinder 16 is cleared by the upper, circular edge 58 of the trailing piston 24, but the transfer duct 42 remains closed at the intake orifice 44 by the skirt of the piston 22. Only when the controlling lower edge 60 of the aperture 48 clears the upper edge 62 of the orifice 44, the transfer duct 42 is opened. At this stage, there is a pressure differential of approximately one atmosphere between the crank chamber 34 and the combustion chamber 18, and the compressed fluid flows approximately at the velocity of sound through the cavity of the piston 22, the transfer port 42, and the upper compartment of the cylinder 16 into the combustion chamber 18 and the upper compartment of the cylinder 14. In the lowermost position of the piston 22, the transfer port 42 and the exhaust port 50 are both wide open, and the upper edge 58 of the trailing piston 24 is well below the discharge orifice 46 of the port 42.

Thereafter, the pistons 22, 24 move upward. The lower edge 60 of the aperture 48 passes the upper edge 62 of the intake orifice 44 to seal the transfer port 42. Only thereafter, the exhaust port 50 in the cylinder 14 is closed by the rising piston 22. If only air was taken in from the duct 40, a metered amount of liquid fuel is injected through a nozzle 77 into the transfer port 42 against the direction of air flow, that is, toward the cylinder 14, as is better seen in FIG. 2. If the duct 40 is connected to a carburetor, the nozzle 77 is plugged, but a mixture of fuel and air of combustion also is present in the upper cylinder compartments at this stage and is being compressed by the pistons 22, 24, and ignited when the pistons approach their top dead center positions. A sparkplug is mounted in the combustion chamber 18 on a wall cut away in the view of FIG. 1. The exploding fuel mixture drives the pistons downward and turns the crank shaft 28.

Figure 4:
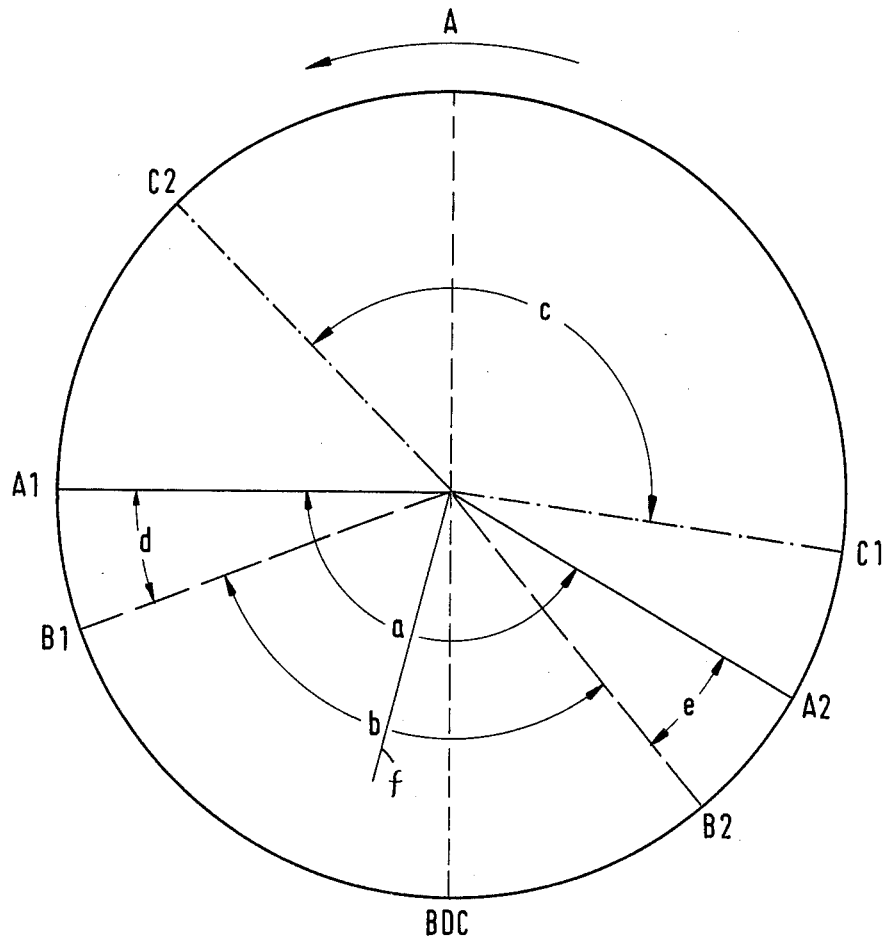
FIG. 4 is a port timing diagram of the engine of FIGS. 1 to 3.

The manner in which the opening and closing of the several ports is timed is shown in FIG. 4 in a conventional manner for one revolution of the disc 30 and of the shaft 28. The disc and the shaft turn in the direction of the arrow A, and the bottom dead center position BDC determines a reference line. Radii in solid lines bound the angle *a* of exhaust which represents the period from the opening moment A1 of the exhaust port 50 by the piston 22 to the closing moment A2. Broken lines enclose the transfer angle *b*, that is, the angular displacement of the disc 30 from the opening moment B1 to the closing moment B2 of the transfer port 42 by the piston 22. Chain-dotted lines enclose the intake angle *c* defined by the times C1 and C2 at which the intake port 52 leading to the duct 40 is cleared by a radially reduced face portion 64 of the disc 30.

As is evident from FIG. 4, the transfer angle *b* is located within the exhaust angle *a* and arranged symmetrically relative to the latter. The angle *d* separating the times A1 and B1 is equal to the angle *e* between the times B2 and A2, and a line *f* bisecting the angle *a* also bisects the angle *b*. This symmetrical disposition is due to the fact that the leading piston 22 controls both the exhaust timing and the transfer timing. Contrary to the timing of conventional two-stroke-cycle engines with dual pistons, the line *f* bisecting both the exhaust angle *a* and the transfer angle *b* is offset from the bottom dead center position against the direction of crank shaft rotation.

Because of this arrangement, the transfer port 42 is closed when the trailing piston 24 is still near its lowermost position. Because the exhaust port is open simultaneously, there is still a pressure differential between the crank chamber 34 and the combustion chamber 18 at time B2. No fresh fuel mixture can flow backward from the upper cylinder compartments into the crank chamber 34, as is unavoidable in conventional engines of the same general type. The angles *d* and *e* are chosen in such a manner that the exhaust port 50 is closed when the fresh fuel mixture reaches the port.

The magnitude of the angles *a, b, c, d,* and *e* can be varied within obvious limits without losing the advantages pointed out above.

As is evident from FIGS. 1 and 3, the combustion chamber is confined in an area bounded by parallel planes perpendicular to the plane of FIG. 1 and including the two cylinder axes, and the upper cylinder compartments, for this reason, are only partly open toward the combustion chamber, and partly closed in an axial direction by the cylinder head 20. When the fuel mixture from the upper compartment of the cylinder 16 enters the combustion chamber 18, the flowing liquid is squeezed into an opening smaller than the cylinder cross section and subjected to thorough mixing by the resulting turbulence. The specific shape of the combustion chamber 18 enhances this mixing effect.

The combustion chamber 18 has a main portion bounded by a wall cylindrical about an axis parallel to and equidistant from the axes of the cylinders 14, 16, and the cylinder head 20 is formed with two recesses 51, 53 contiguous to the main portion and diametrically opposite each other relative to the axis of the chamber 18. The recesses are open toward the respective cylinders and are axially bounded outward of the cylinders by walls 55, 57 having each the approximate shape of a spherical triangle.

Because of the configuration of the recesses 51, 53, fluid flows from the cylinders 14, 16 into the combustion chamber 18 in paths that have predominant tangential components indicated by arrows in FIG. 3. A spin of up to 200 r.p.m. has been observed in the gases contained in the combustion chamber of an actual embodiment of the illustrated engine.

Modified transfer ports and exhaust ports in the otherwise unchanged engine shown in FIGS. 1 to 3 are illustrated in FIGS. 5, 6, and 7. The flow paths of compressed air or compressed fuel mixture, and the flow paths of exhaust gases are indicated in each of these Figures by arrows.

The transfer port 42 shown in FIG. 5 is closely similar to that illustrated in FIG. 2 in a similar view, in that the transfer port leads from the cylinder 14 tangentially into the cylinder 16. The resulting rotary flow of the fresh fuel mixture reduces intermingling with the combustion gases about to be exhausted. The fresh fuel mixture pushes the spent mixture ahead through the combustion chamber 18 into the cylinder 14 and out through an exhaust port having two orifices 66, 68 which communicate with an arcuately bent exhaust duct 70. While rotary flow of the fresh mixture is counterclockwise in both cylinders, as viewed from the cylinder head down, the duct 70 imparts to the exhaust gases a clockwise arcuate movement. This arrangement minimizes mixing of the fresh fuel mixture with the exhaust gases.

The modified engine partly illustrated in FIG. 6 differs from that of FIG. 5 by the provision of two transfer ports 72, 74 whose intake and discharge orifices are located on respective common levels and controlled by correspondingly modified skirt apertures. Because of the increased combined lateral width of the ports 72, 74, the axial height of each port is reduced to less than the corresponding dimension of a single port 42 for equal flow rate. This permits a reduction in the magnitude of the transfer angle *b* (FIG. 4) and an increase in the swept volume. The streams of fluid entering the cylinder 16 from the transfer ports 72, 74 are directed in such a manner that they both turn clockwise in the cylinder 16, the exhaust duct being bent to impart counterclockwise rotary movement to the exhaust gases for reduced mixing of fresh and spent fuel mixture.

The engine illustrated in FIG. 7 has a transfer port 72 identical with the corresponding element of FIG. 6, and a transfer port 74' which discharges fluid tangentially into the cylinder 16 to produce counterclockwise movement. The two streams of fuel mixture thus collide head-on in the cylinder 16 and are thereby deflected toward the combustion chamber 18 which is filled more rapidly than in other embodiments of the invention. There being no distinct rotary fluid flow due to the orientation of the transfer ports 72, 74', the exhaust duct 76 leading away from the exhaust port orifices 66, 68 is straight. In an engine rotating at high speed, the quicker filling of the combustion chamber outweighs the aforedescribed advantages of the devices seen in FIGS. 5 and 6.

The connecting rod assembly 26 whose features are best understood from joint consideration of FIGS. 1 and 2 is common to the several embodiments of the invention discussed so far. Two piston rods 82, 84 are attached to the pistons 22, 24 by wrist pins 78, 80 respectively. The lower ends of the piston rods are integrally connected to an annular element 86 obscuring the connecting rod bearing on the eccentric crank pin 27. The longitudinal axes of the connecting rods 82, 84 are approximately tangential to the non-illustrated bearing and the circular circumference of the element 86 on opposite sides of the eccentric crank pin 27. They are sufficiently resilient to yield when the spacing of the wrist pins 78, 80 varies during rotation of the disc 30. The resilient tension of the connecting rods causes guiding engagement of the pistons 22, 24 with the associated cylinder walls with a slight pressure sufficient to suppress any radial movement of the pistons which would otherwise be permitted by the normal clearance between pistons and cylinders.

Because of the tangential orientation of the connecting rods 82, 84 relative to the annular element 86, the connecting rods are longer than they would be if they were joined radially to the element 86 at equal overall length of the connecting rod assembly 26. Even a slight increase in the length of a resilient connecting rod sharply reduces the radial contact pressure between piston and cylinder and the resulting wear. The illustrated arrangement of the connecting rods also causes the load transmitted by the connecting rods to the associated anti-friction bearing to be distributed over more bearing balls or rollers than would be possible with a radial orientation of the connecting rods. The more equal loading significantly increases the useful life of the non-illustrated connecting rod bearing.

It has been found that the two-stroke-cycle engine of the invention combines great power output with relatively low fuel consumption and can be scaled up successfully to swept cylinder volumes available heretofore only from four-stroke-cycle engines.

The swept volume in single-piston two-stroke-cycle engines is limited by difficulties of a thermal nature which arise as the cylinder diameter is increased. In a dual-piston two-stroke-cycle internal combustion engine, the effective cross section of the engine can be increased while the actual cross section of each cylinder remains relatively small. The maximum permissible piston stroke is related in a known manner to the effective cross sectional area so that the stroke of an engine of the invention can be made greater than would be permissible with individual cylinders of the actual cross section of each of the dual cylinders. An increase in stroke length facilitates the construction of the crank shaft because it requires an increased radial spacing of the shaft 28 from the crank pin 27, thereby permitting the shaft and the crank pin to be assembled with the disc 30 by a press fit without splitting the disc. This assembly method is much less costly than the forging of a disc integral with a shaft and crank pin which would otherwise have to be resorted to.

Because of their lower compression ratio, two-stroke-cycle engines as a class produce less nitrogen oxide than otherwise comparable four-stroke-cycle engines. It is a disadvantage of conventional two-stroke-cycle engines that they discharge unburnt hydrocarbons at a high rate, typically 25% of the fuel supplied, thereby more than balancing the environmental advantage due to low nitrogen oxide emission. The hydrocarbons emitted by the engines of the invention are of the order of 10% and similar to the amounts of hydrocarbons in the exhaust of four-stroke-cycle engines. The better utilization of the combustible fuel is inherently due to the better control of exhaust and transfer ports in the engines of the invention, as compared to two-stroke-cycle engines known heretofore.

What is claimed is:

1. In a two-stroke cycle internal combustion engine having a first cylinder formed with an exhaust port, a second cylinder, said cylinders having respective axes, a crank chamber communicating with said cylinders, means for admitting a fluid to said crank chamber, first and second pistons respectively received in said cylinders for simultaneous reciprocating axial movement, each piston axially dividing the associated cylinder into a first compartment open toward said crank chamber and a second compartment permanently communicating with the second compartment of the other cylinder, said first piston leading, and said second piston trailing during said reciprocating movement, a crank shaft connected to said pistons for rotation of said crank shaft in said crank chamber in a predetermined direction in response to said reciprocating movement, said crankshaft including a crank pin assuming an angular bottom dead center position when said pistons are nearest said crank chamber, first control means on said first piston for opening and closing said exhaust port during each reciprocating movement of said first piston, said exhaust port remaining open while said crank shaft moves through a first angle, means defining a transfer port, said transfer port when open connecting the first compartment of said first cylinder with the second compartment of said second cylinder for flow of fluid between the connected compartments, second control means on one of said pistons for opening and closing said transfer port during each reciprocating movement of said one piston, said transfer port remaining open while said crank shaft moves through a second angle, the improvement which comprises:

(a) said second control means including means opening said transfer port after the opening of said exhaust port by said first control means, and closing said transfer port before the closing of said exhaust port by said first control means;
(b) said one piston being said first piston;
(c) a line bisecting said first angle also bisecting said second angle;
(d) said line being offset from said bottom dead center position in a direction opposite to said predetermined direction; and
(e) said transfer port having two orifices directed tangentially relative to the circumference of said second compartment of said second cylinder in a manner to impart rotary movement in opposite respective directions to two streams of fluid flowing from said orifices into said second cylinder.

2. In an engine as set forth in claim 1, an arcuate exhaust duct directly communicating with said exhaust port for leading a stream of fluid from said exhaust port outward of said first cylinder in a curved path, the curvature of said path being opposite to said predetermined direction of rotation.

3. In an engine as set forth in claim 1, a cylinder head bounding said second compartments in an axial direction and being formed with a combustion chamber open toward each of said second compartments, said chamber being located substantially completely in an area bounded by respective parallel planes through the axes of said cylinders, said planes being perpendicular to a plane including the axes of both cylinders.

4. In an engine as set forth in claim 3, said chamber having a wall arcuate about an axis of curvature parallel to said axes of said cylinders, and said cylinder head being formed with a recess open toward said second cylinder and said combustion compartment and defining a flow path for fluid from said second cylinder to said combustion chamber, said flow path being directed tangentially relative to said wall.

5. In an engine as set forth in claim 1, a connecting pin assembly connecting said pistons to said crank shaft and including an element annular about an axis and two elongated connecting rods having respective longitudinal axes tangential to said annular element on opposite sides of the axis of the same.

6. In a two-stroke cycle internal combustion engine
having a first cylinder formed with a exhaust port,
a second cylinder, said cylinders having respective axes,
a crank chamber communicating with said cylinders,
means for admitting a fluid to said crank chamber,
first and second pistons respectively received in said cylinders for simultaneous reciprocating axial movement, each piston axially dividing the associated cylinder into a first compartment open toward said crank chamber and a second compartment permanently communicating with the second compartment of the other cylinder, said first piston leading, and said second piston trailing during said reciprocating movement,
a crank shaft connected to said pistons for rotation of said crank shaft in said crank chamber in a predetermined direction in response to said reciprocating movement, said crankshaft including a crank pin assuming an angular bottom dead center position when said pistons are nearest said crank chamber,
first control means on said first piston for opening and closing said exhaust port during each reciprocating movement of said first piston, said exhaust port remaining open while said crank shaft moves through a first angle,
means defining a transfer port, said transfer port when open connecting the first compartment of said first cylinder with the second compartment of said second cylinder for flow of fluid between the connected compartments,
second control means on one of said pistons for opening and closing said transfer port during each reciprocating movement of said one piston, said transfer port remaining open while said crank shaft moves through a second angle,
the improvement which comprises:
(a) said second control means including means opening said transfer port after the opening of said exhaust port by said first control means, and closing said transfer port before the closing of said exhaust port by said first control means;
(b) said one piston being said first piston;
(c) a line bisecting said first angle also bisecting said second angle;
(d) said line being offset from said bottom dead center position in a direction opposite to said predetermined direction; and
(e) a fuel injection nozzle having an orifice in said transfer port directed toward said first cylinder.

7. In a two-stroke cycle internal combustion engine
having a first cylinder formed with an exhaust port,
a second cylinder, said cylinders having respective axes,
a crank chamber communicating with said cylinders,
means for admitting a fluid to said crank chamber,
first and second pistons respectively received in said cylinders for simultaneous reciprocating axial movement, each piston axially dividing the associated cylinder into a first compartment open toward said crank chamber and a second compartment permanently communicating with the second compartment of the other cylinder, said first piston leading, and said second piston trailing during said reciprocating movement,
a crank shaft connected to said pistons for rotation of said crank shaft in said crank chamber in a predetermined direction in response to said reciprocating movement, said crankshaft including a crank pin assuming an angular bottom dead center position when said pistons are nearest said crank chamber,
first control means on said first piston for opening and closing said exhaust port during each reciprocating movement of said first piston, said exhaust port remaining open while said crank shaft moves through a first angle,
means defining a transfer port, said transfer port when open connecting the first compartment of said first cylinder with the second compartment of said second cylinder for flow of fluid between the connected compartments,
second control means on one of said pistons for opening and closing said transfer port during each reciprocating movement of said one piston, said transfer port remaining open while said crank shaft moves through a second angle,
the improvement which comprises:
(a) said second control means including means opening said transfer port after the opening of said exhaust port by said first control means, and closing said transfer port before the closing of said exhaust port by said first control means;

(b) said one piston being said first piston;

(c) a line bisecting said first angle also bisecting said second angle;

(d) said line being offset from said bottom dead center position in a direction opposite to said predetermined direction; and (e) said transfer port having two orifices in the circumference of said second cylinder and including means for imparting rotary movement in the same direction to two streams of fluid flowing from said orifices into said second cylinder.

* * * * *